US008926063B2

(12) United States Patent
Ikeda et al.

(10) Patent No.: US 8,926,063 B2
(45) Date of Patent: Jan. 6, 2015

(54) PRINTING METHOD AND PRINTING APPARATUS

(75) Inventors: Akira Ikeda, Tomi (JP); Masaru Ohnishi, Tomi (JE)

(73) Assignee: Mimaki Engineering Co., Ltd., Tomi (JP)

( * ) Notice: Subject to any disclaimer, the term of this patent is extended or adjusted under 35 U.S.C. 154(b) by 0 days.

(21) Appl. No.: 14/125,088

(22) PCT Filed: Jul. 6, 2012

(86) PCT No.: PCT/JP2012/067392

§ 371 (c)(1), (2), (4) Date: Dec. 10, 2013

(87) PCT Pub. No.: WO2013/011851

PCT Pub. Date: Jan. 24, 2013

(65) Prior Publication Data

US 2014/0132670 A1 May 15, 2014

(30) Foreign Application Priority Data

Jul. 15, 2011 (JP) ..... 2011-157107

(51) Int. Cl.

| | |
|---|---|
| ***B41J 29/393*** | (2006.01) |
| ***B41J 23/00*** | (2006.01) |
| ***B41J 25/304*** | (2006.01) |
| ***B41M 5/00*** | (2006.01) |
| ***B41J 3/407*** | (2006.01) |
| ***B05C 5/00*** | (2006.01) |

(52) U.S. Cl.

CPC ..... *B41J 25/304* (2013.01); *B41M 5/0088* (2013.01); *B41J 3/4073* (2013.01); *B05C 5/00* (2013.01)

USPC ..... 347/37; 347/19

(58) Field of Classification Search

CPC ..... B41J 25/304

USPC ..... 347/37, 19

See application file for complete search history.

(56) References Cited

U.S. PATENT DOCUMENTS

2009/0169719 A1* 7/2009 Orr ..... 427/8

FOREIGN PATENT DOCUMENTS

| | | | |
|---|---|---|---|
| JP | 9-193368 | A | 7/1997 |
| JP | 11-276978 | A | 10/1999 |
| JP | 2001-260329 | A | 9/2001 |

(Continued)

OTHER PUBLICATIONS

International Search Report in International Application No. PCT/JP2012/067392 dated Oct. 9, 2012.

*Primary Examiner* — Jason Uhlenhake

(74) *Attorney, Agent, or Firm* — Park, Kim & Suh, LLC

(57) ABSTRACT

The invention aims to form an ink coating having a predetermined film thickness on a surface of a printing medium having a three-dimensional structure in shorter time. As solving means, a plurality of times of scanning process is included, ink 80 is discharged to head-facing areas (10*a*, 10*c*) in a state of facing straight toward a printhead 110 in one scanning process, and the ink 80 is discharged to a non-head-facing area (10*b*) so that the total film thickness of the ink coatings (11, 12) to be formed without facing straight toward the printhead 110 in two or more times of the scanning process becomes a predetermined film thickness $T_0$.

11 Claims, 5 Drawing Sheets

(56) References Cited

FOREIGN PATENT DOCUMENTS

| | | | |
|---|---|---|---|
| JP | 2003-320299 | A | 11/2003 |
| JP | 2005-254817 | A | 9/2005 |
| JP | 2006-335019 | A | 12/2006 |
| JP | 2007-106049 | A | 4/2007 |
| JP | 2009-12430 | A | 1/2009 |

* cited by examiner

PRINTING METHOD AND PRINTING APPARATUS

CROSS-REFERENCE TO RELATED APPLICATIONS

This application is the National Stage filing under 35 U.S.C. 371 of International Application No. PCT/JP2012/067392, filed on Jul. 6, 2012, which claims the benefit of Japanese Patent Application No. 2011-157107, filed on Jul. 15, 2011, the contents of which are all hereby incorporated by reference herein in their entirety.

TECHNICAL FIELD

The present invention relates to a printing technology, and more specifically, to a technology for performing ink jet printing on a printing medium having a three-dimensional structure.

BACKGROUND ART

As an example of a technology for performing ink jet printing on printing media having level differences, projections and depressions, corners, and curved surfaces or the like (for example, polyhedron, solid bounded by curved surface), PTL 1 discloses increasing the amount of ink discharge in segments having a large angle of inclination in an inclined surface, a curved surface, or the like so as to prevent formation of clearances among dots to be formed by the ink. Also, PTL 2 discloses a technology for performing printing by inclining printing media.

CITATION LIST

Patent Literature

PTL 1: JP-A-9-193368 (published Jul. 29, 1997)
PTL 2: JP-A-2006-335019 (published Dec. 14, 2006)

SUMMARY OF INVENTION

Technical Problem

However, in the related art, in a case of forming an ink coating having a predetermined film thickness on surfaces of printing media having the three-dimensional structure, there is a problem of time consumption. For example, in the printing medium, if an attempt is made to increase resolution and reduce an ink landing interval as in the technology disclosed in PTL 1 in order to prevent thinning of the thickness of the coating in segments having a large angle of inclination in an inclined surface, a curved surface, or the like, a printing speed is lowered. In contrast, as in PTL 2, when printing with the printing medium inclined so that a surface to be printed always faces straight toward a printhead, the thickness of the coating does not decrease even in a segment having a large degree of inclination. However, long time is required for rotating and stopping the printing medium (the positioning action between the printhead and the printing medium).

In view of the above-described problems, it is a main object of the present invention to provide a technology for forming an ink coating having a predetermined film thickness on a surface of a printing medium having a three-dimensional structure in shorter time.

Solution to Problem

In order to solve the above-described problem, a printing method of the present invention includes: a plurality of times of a scanning process including scanning with a printhead for ink jet printing and discharging ink to a printing medium from the printhead, and is characterized in including differentiating head-facing areas to which the ink is discharged in a state of facing straight toward the printhead from each other in the respective scanning processes, discharging the ink to a non-head-facing area to which the ink is discharged in a state of not facing straight toward the printhead in any of the scanning processes without facing the non-head-facing area straight toward the printhead also in other one or more scanning processes, and adjusting the amount of the ink to be discharged to the non-head-facing area in at least one of the scanning processes so that the total film thickness of the ink coating formed in the non-head-facing area becomes a predetermined film thickness.

According to the above-described configuration, ink is discharged in two or more times of the scanning processes to each of areas which correspond to the non-head-facing area in any of the scanning processes. Therefore, the film thickness of the ink coating to be formed in the non-head-facing area is prevented from becoming thinner than the head-facing area.

In addition, according to the above-described configuration, since all of the surfaces of the printing medium are not faced straight toward the printhead for printing, an operation for differentiating areas facing straight toward the printhead in the respective scanning processes (the positioning action between the printhead and the printing medium) can be reduced in comparison with the case of printing with all of the surfaces of the printing medium faced straight toward the printhead for printing, so that the printing time may be reduced.

Also, in the above-described configuration, unlike the technology disclosed in PTL 1, a specific mechanism for improving the resolution or increasing the ink discharging amount (for example, a highly precise head scanning mechanism or the like) is not necessary.

As described above, according to the above-described configuration, the ink coating having a predetermined film thickness is formed on a surface of a printing medium having a three-dimensional structure in shorter time.

In the above-described printing method, the above-described amount of the ink to be discharged in the above-described non-head-facing area is preferably adjusted so that the total film thickness of the above-described ink coating formed in the above-described non-head-facing area becomes equal to the film thickness of the above-described ink coating to be formed on the above-described head-facing area in the above-described at least one of the scanning processes.

In the above-described configuration, the ink coating having the same film thickness as the head-facing area may be formed also in the non-head-facing area.

In the above-described printing method, the above-described amount of the ink to be discharged in the above-described non-head-facing area is preferably adjusted to be smaller than the above-described amount of ink to be discharged to the above-described head-facing area in at least one of the above-described scanning processes.

In the above-described configuration, by reducing the amount of ink to be discharged in the non-head-facing area to an amount smaller than the amount of ink to be discharged in the head-facing area in at least one of the scanning processes and discharging the ink to the non-head-facing area in two or more times of the scanning process, the ink coating having the predetermined film thickness may be successfully formed in the non-head-facing area.

In the above-described printing method, preferably, when the above-described ink is discharged to one point in the above-described non-head-facing area in the n times (n is integers of 2 or larger) of the above-described scanning process, an amount $D_i$ of the above-described ink to be discharged to the point in the i-th above-described scanning process is set so as to satisfy the following expression (2)

$$D_i = k_i \times D_0 \quad (2)$$

(where $D_0$ denotes the above-described amount of the ink to be discharged to one point in the above-described head-facing area in the respective scanning processes) by using a coefficient of adjustment $k_i$ set so as to satisfy the following expression (1)

[Expression 1]

$$\sum_{i=1}^{n} (k_i \cos\theta_i) = 1 \quad (1)$$

(where $\theta_i$ is an angle smaller than 90°, and indicates an angle formed between a discharging direction of the above-described ink in the above-described i-th scanning process among the above-described n times of the scanning process and a normal direction of the above-described printing medium at that time point.).

In the above-described configuration, since the discharging amount of the ink with respect to one point of the non-head-facing area may be preferably adjusted so that the film thickness of the ink coating to be formed on one point of the above-described non-head-facing area becomes the same as the film thickness of the ink coating to be formed in the head-facing area, the ink coating having the predetermined film thickness may be successfully formed on the surface of the printing medium.

In the above-described printing method, scanning with the above-described printhead is preferably performed so as to transverse the above-described head-facing area and the above-described non-head-facing area in the at least one of the above-described scanning processes.

In the above-described configuration, since the scanning with the printhead is performed so as to transverse the head-facing area and the non-head-facing area, both of the head-facing area and the non-head-facing area can be scanned in one time of the scanning process without performing the positioning action between the printhead and the printing medium. Accordingly, the number of times of the positioning action may be reduced, and hence the printing time may be reduced.

For example, when printing on side surfaces of a printing medium having a polygonal column shape with all the surfaces faced straight toward the printhead, the positioning action between the printhead and the printing medium is increased and the printing time is increased. However, according to the above-described configuration, for example, what is necessary is only that the side surfaces are faced straight toward the printhead alternately and that the intermediate surface is printed as the non-head-facing areas, and hence the positioning action between the printhead and the printing medium is reduced, and the printing time may be reduced.

Also, for example, when printing on side surfaces of a printing medium having a column shape with an entire surface faced straight toward the printhead, the positioning action between the printhead and the printing medium is very much increased and the printing time is increased. However, according to the above-described configuration, for example, what is necessary is only that the side surface is divided into a plurality of areas in the circumferential direction, and that the respective divided surfaces are printed in two or more scanning processes, and hence the positioning action between the printhead and the printing medium is reduced, and the printing time may be reduced.

In the above-described printing method, a configuration in which the above-described ink is discharged to a first area, which is part of the above-described printing medium, without facing the printhead straight toward the first area in two or more times of the above-described scanning process, the two or more times of the scanning process includes one time of type 1 scanning process and one or more times of type 2 scanning process, the same amount of above-described ink as the amount to be discharged to the above-described head-facing area is discharged to the first area in the type 1 scanning process, and an amount of the above-described ink smaller than the amount to be discharged to the above-described head-facing area is discharged to the first area in the type 2 scanning process.

In the above-described configuration, since the same amount of ink is discharged to the head-facing area and the first area in the type 1 scanning process, the film thickness of the ink coating to be formed in the first area in the type 1 scanning process is thinner than the film thickness of the ink coating formed in the head-facing area. However, since the ink is further applied to the first area in the type 2 scanning process, the ink coating having the predetermined film thickness may be formed in the first area.

Here, since the ink to be discharged in the same scanning process as the head-facing area occupies a larger ratio in the ink to be discharged to the first area in the above-described configuration when the printing medium is observed mainly with the head-facing area in the type 1 scanning process oriented to the front, the printed image quality of in the first area when observing from the front may be improved.

In the above-described printing method, the above-described ink is discharged to a second area, which is part of the above-described printing medium, without facing the above-described printhead straight toward the second area in two or more times of the above-described scanning processes, the two or more times of the scanning process includes two or more times of type 3 scanning process, and the above-described ink is discharged so that coatings of the above-described ink having the same film thickness are formed in the second area in the respective times of the type 3 scanning process.

In the above-described configuration, by discharging ink to the second area so that the film thickness of the ink coatings to be formed in the second area in the respective processes are the same and the total film thickness to be formed has a predetermined film thickness in two or more times of the type 3 scanning process, the ink coating having the predetermined film thickness may be formed on the surface of the printing medium.

Here, in a case where the printing medium is observe from various directions, according to the above-described configuration, since the film thicknesses of the ink coating to be formed in the second area in the respective third scanning processes are uniform, such an event that the printed image quality in the second area is deteriorated when observing from a certain direction is suppressed.

In the above-described printing method, the above-described ink is discharged to a third area, which is part of the above-described printing medium without facing the above-described printhead straight toward the third area in the above-described two or more times of the scanning processes, the two or more times of the scanning process includes two or more times of type 4 scanning process, scanning with the above-described printhead is performed so as to transverse the third area and the above-described head-facing area in the respective type 4 scanning processes, the same amount of above-described ink as the amount to be discharged to the above-described head-facing area is discharged to a boundary between the third area and the above-described head-facing area, and the above-described amount of ink to be discharged is continuously changed from the boundary to the third area.

According to the above-described configuration, in the type 4 scanning process, by discharging the same amount of the ink as that in the head-facing area to a boundary between the head-facing area and the third area which are continuously printed, continuity of printing between the head-facing area and the third area is secured, so that the printed image quality is improved.

Here, when the areas to which the same amount of ink as the head-facing area is discharged overlap in the third area between the plurality of type 4 scanning processes, the total film thickness of the ink coating to be formed in the third area may exceed the predetermined film thickness. However, since the head-facing areas in the respective type 4 scanning processes are different from each other, boundaries between the head-facing area and the third area are also different. In addition, since the amount of ink to be discharged is continuously changed from the above-described boundary to the third area, the portions to which the same amount of ink is discharged as the head-facing area do not overlap in the respective type 4 scanning processes, and the discharging amount of the ink may be adjusted so that the ink coating having the predetermined total film thickness is formed in the third area.

Also, the head-facing area is closer to the printhead than the non-head-facing area. Therefore, by setting the ink discharging amount on the boundary with respect to the head-facing area to be large in the third area as described above, a large amount of the ink is discharged in a state of being closer to the printhead, and hence the image quality in the third area may be improved.

A portion where the ink discharging amount is to be changed may extend over the entire part of the third area, or may be limited to part of the third area depending on a pattern or the like to be printed.

In the above-described printing method, the above-described ink is discharged to a fourth area, which is part of the above-described printing medium, without facing the above-described printhead straight toward the fourth area in two or more times of the above-described scanning processes, the two or more times of the scanning process includes two or more times of type 5 scanning process, scanning with the above-described printhead is performed so as to transverse the fourth area and the above-described head-facing area in the respective type 5 scanning processes, the above-described same amount of ink as the amount to be discharged to the above-described head-facing area is discharged to a boundary between the fourth area and the above-described head-facing area, and the above-described amount of ink to be discharged is unevenly changed from the boundary to the fourth area.

According to the above-described configuration, in the type 5 scanning process, by discharging the same amount of the ink as that in the head-facing area to a boundary between the head-facing area and the fourth area which are continuously printed, continuity of printing between the head-facing area and the fourth area is secured, so that the printed image quality may be improved.

Here, when the areas to which the same amount of ink as the head-facing area is discharged overlap in the fourth area between the plurality of type 5 scanning processes, the total film thickness of the ink coating to be formed in the fourth area may exceed the predetermined film thickness. However, since the head-facing areas in the respective type 5 scanning processes are different from each other, boundaries between the head-facing area and the fourth area are also different. In addition, since the amount of ink to be discharged is unevenly changed from the above-described boundary to the fourth area, the portions to which the same amount of ink as the head-facing area do not overlap in the respective type 5 scanning processes, and the discharging amount of the ink may be adjusted so that the ink coating having the predetermined total film thickness is formed in the fourth area.

In addition, according to the above-described configuration, by changing the amount of the ink to be discharged unevenly from the above-described boundary to the fourth area, occurrence of the unevenness which can be generated when repeating the plurality of times of printing may be preferably suppressed. As a method of changing the ink discharging amount unevenly, for example, a method of setting a displacement width to cause the fluctuation within the displacement width may be used.

Also, the head-facing area is closer to the printhead than the non-head-facing area. Therefore, by setting the ink discharging amount on the boundary with respect to the head-facing area to be large in the fourth area as described above, a large amount of the ink is discharged in a state of being closer to the printhead, and hence the image quality in the fourth area may be improved.

In the above-described printing method, when scanning with the above-described printhead is performed so as to transverse the above-described head-facing area and the above-described non-head-facing area and the above-described amount of the ink to be discharged to the above-described printing medium is changed between the above-described non-head-facing area and the above-described head-facing area, positions where the amount of the ink is changed may be varied.

In the above-described configuration, since the position where the ink discharging amount is changed between the head-facing area and the non-head-facing area varies, a seam between the head-facing area and the non-head-facing area may be blurred, so that an unpleasant sensation may be resolved.

A printing apparatus of the present invention includes: a printhead for ink jet printing; scanning control means configured to control the printhead to perform a scanning process in which ink is discharged from the printhead to a printing medium while scanning with the printhead by a plurality of times; and head-facing area changing means configured to differentiate head-facing areas to which the ink is discharged in a state of facing straight toward the printhead straight from each other in the respective scanning processes, and is characterized in that the scanning control means controls the printhead so that the ink is discharged to a non-head-facing area to which the ink is discharged in a state of not facing the non-head-facing area straight toward the printhead in any one of the scanning processes, and adjusts the amount of the ink to be discharged to the non-head-facing area in at least one of the scanning processes so that the total film thickness of the ink coating formed in the non-head-facing area becomes equal to the film thickness of the ink coating to be formed on the head-facing area.

According to the above-described configuration, the same effects and advantages as the printing method according to the present invention are achieved.

Advantageous Effects of Invention

Advantageous Effects

According to the present invention, an ink coating having a predetermined film thickness is formed on a surface of a printing medium having a three-dimensional structure in shorter time.

DESCRIPTION OF EMBODIMENTS

Outline of Printing Apparatus

Figure 5:
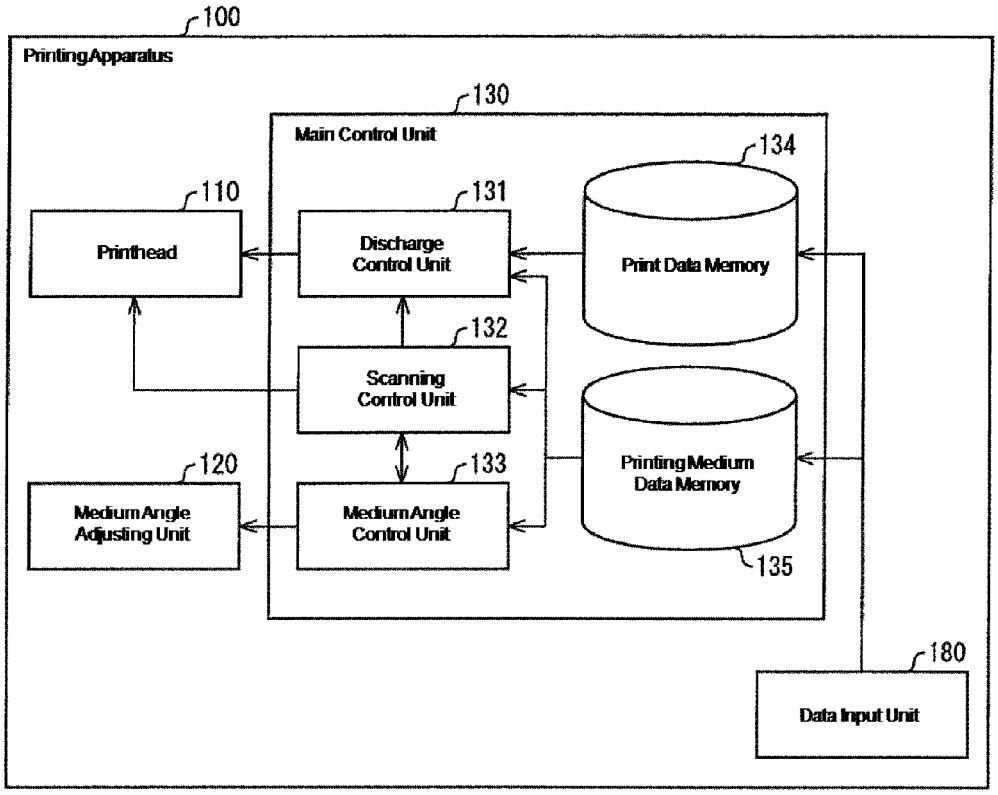
FIG. 5 is a functional block diagram illustrating a schematic configuration of a printing apparatus according to the embodiment of the present invention.

FIG. 5 is a functional block diagram illustrating a schematic configuration of a printing apparatus 100 according to an embodiment of the present invention. As illustrated in FIG. 5, the printing apparatus 100 includes a printhead 110, a medium angle adjusting unit (head-facing area changing means) 120, a main control unit 130, and a data input unit 180. The main control unit 130 includes a discharge control unit (scanning control means) 131, a scanning control unit (scanning control means) 132, a medium angle control unit (head-facing area changing means) 133, a print data memory 134, and a printing medium data memory 135.

The printhead 110 is a printhead for ink jet printing, and is configured to be capable of scanning linearly in predetermined directions. A discharging direction of ink 80 from the printhead 110 is set to be perpendicular to the direction of scanning of the printhead 110. Therefore, the ink 80 discharged from the printhead 110 to a surface facing straight toward the printhead 110 lands perpendicularly at the corresponding surface. In this specification, the term a certain surface "faces the printhead straight in front thereof" indicates that a normal direction of the corresponding surface matches the discharging direction of the ink from the printhead. The ink 80 discharged from the printhead 110 which may be used as needed includes ink for ink jet printing.

The medium angle adjusting unit 120 is, for example, configured to hold the printing medium, which is an object of printing, by a physical or electromagnetic mechanism (for example, a gripping mechanism, a magnet, and the like), and adjust the orientation (angle) of the printing medium by a universal mechanism such as an actuator (for example, rotate the printing medium). The medium angle adjusting unit 120 is configured to change an area (head-facing area) of the printing medium, which faces straight toward the front of the printhead 110 by adjusting the orientation of the printing medium. The medium angle adjusting unit 120 only has to be capable of adjusting the relative positional relationship between the printhead 110 and the printing medium and, for example, a configuration in which the area facing the printhead 110 straight in front (a head-facing area) thereof on the printing medium is changed by adjusting the position of the printhead 110 is also applicable.

The main control unit 130 may be implemented as hardware by a logical circuit formed on an integrated circuit (IC chip), or may be implemented as software by using a CPU (Central Processing Unit). The main control unit 130 is also provided with memory means as needed for memorizing data.

The discharge control unit 131 controls the discharging amount of the ink 80 from the printhead 110. The scanning control unit 132 controls scanning operation of the printhead 110. The printing apparatus 100 executes a scanning process for controlling the printhead 110 by the cooperation of the discharge control unit 131 and the scanning control unit 132, and causing the printhead 110 to discharge the ink 80 onto the printing medium while causing the printhead 110 to scan by a plurality of times.

The medium angle control unit 133 controls an adjustment of the orientation of the printing medium performed by the medium angle adjusting unit 120 to differentiate the head-facing areas to which the ink 80 is discharged in a state of facing the printhead 110 straight in front from each other in the respective times of scanning processes. For example, the medium angle control unit 133 executes a head-facing area changing process for changing the orientation of the printing medium during two times of continuous scanning processes.

The print data memory 134 memorizes data indicating image or the like to be printed on the printing medium. The printing medium data memory 135 memorizes parameters calculated from data indicating the shape of the printing medium and the shape of the printing medium, which are to be used in the respective scanning processes and the respective head-facing area changing processes. These data is input from the data input unit 180 to the respective memories.

Outline of Printing Method

Figure 1:
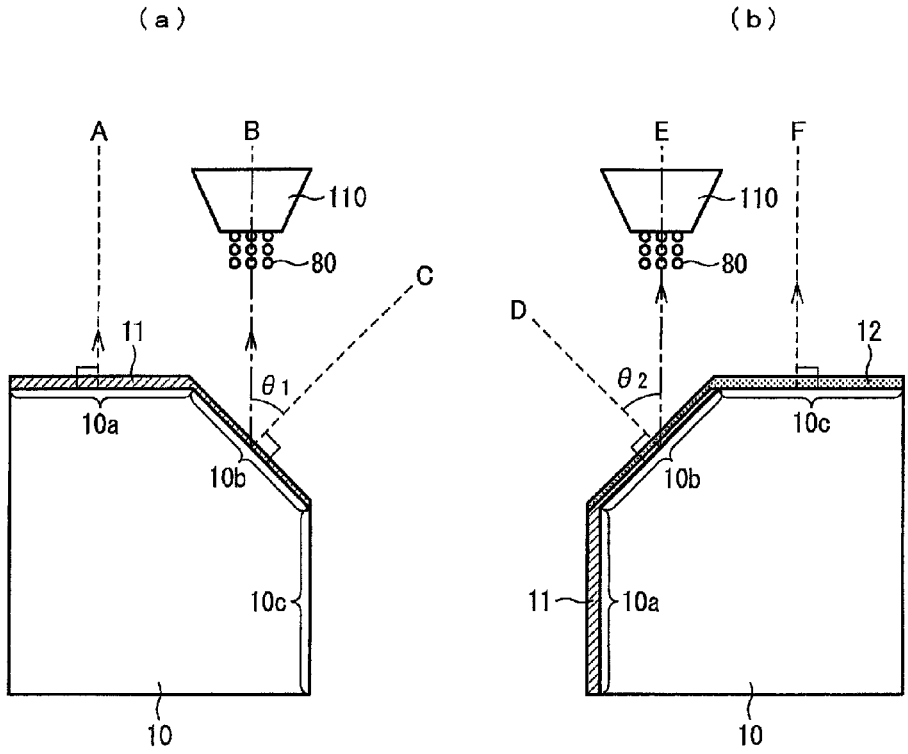
FIGS. 1A and 1B are drawings schematically illustrating some processes of a printing method according to an embodiment of the present invention.

FIGS. 1A and 1B are drawings schematically illustrating some processes of a printing method according to an embodiment of the present invention. As illustrated in FIGS. 1A and 1B, in this embodiment, a case of printing on a polyhedral printing medium 10 will be described.

In this embodiment, printing is performed on the polyhedron with surfaces thereof faced straight toward the front of the printhead 110 alternately. For example, when printing on surfaces 10*a*, 10*b* and 10*c* of the printing medium 10, ink coating having a predetermined film thickness $T_0$ on the surfaces 10*a*, 10*b*, and 10*c* respectively by a scanning process a in which scanning is performed with the surface 10*a* faced straight toward the front of the printhead 110 and a scanning process b in which scanning is performed with the surface 10*c* faced straight toward the front of the printhead 110. Accordingly, printing time may be reduced in comparison with a case where printing is performed by facing all of the surfaces straight toward the front of the printhead 110. The printing method of this embodiment needs only to be capable of reducing the printing time by printing at least one of the surfaces without facing at least one of the surfaces straight toward the printhead 110, and does not necessarily need to print with the surfaces faced straight toward the front of the printhead 110 alternately. In addition, in order to improve the image quality over a wider range, a surface of the printing medium 10 having a larger surface area is preferably selected as the surface of the printing medium 10 to be printed in a state of being faced straight toward the printhead 110.

In this embodiment, a case where the printing medium 10 is a polygonal column having a bottom surface as illustrated in FIG. 1A and FIG. 1B, and the printhead 110 will be described in a case where the scanning direction is a depth direction of the paper plane and a horizontal direction of the paper plane in the drawings of FIGS. 1A and 1B.

FIG. 1A is a drawing schematically illustrating a scanning process a. As illustrated in FIG. 1A, in the scanning process a, the discharge control unit 131 and the scanning control unit 132 control the printhead 110 to discharge the ink 80 toward the surface 10*a* from the direction A perpendicular to the surface 10*a* and discharge the ink 80 toward the surface 10*b* from a direction B, thereby forming the ink coatings 11 on the surface 10*a* and the surface 10*b*.

In the respective times of scanning processes, the scanning control unit 132 may determine a scanning range on the basis of data which indicates the shape of the printing medium 10 memorized in the printing medium data memory 135. Also, the discharge control unit 131 adjusts the discharging amount of the ink 80 on the basis of data indicating the shape of the printing medium 10 memorized in the printing medium data memory 135 in addition to data indicating the image or the like to be printed memorized in the print data memory 134 as described later.

In FIG. 1A, the direction B is parallel to the direction A, and intersects the normal direction C of the surface 10*b* at an angle of $\theta_1$. In other words, in the scanning process a, the surface 10*a* is a head-facing area to which the ink 80 is discharged in a state of facing straight toward the printhead 110 and the surface 10*b* is a non-head-facing area to which the ink 80 is discharged without facing straight toward the printhead 110.

FIG. 1B is a drawing schematically illustrating the scanning process b. As illustrated in FIG. 1B, in the scanning process b, the discharge control unit 131 and the scanning control unit 132 control the printhead 110 to discharge the ink 80 toward the surface 10*c* from a direction F perpendicular to the surface 10*c* and discharge the ink 80 toward the surface 10*b* from a direction E, thereby forming the ink coatings 12 on the surface 10*c* and the surface 10*b*.

In FIG. 1B, the direction E is parallel to the direction F, and intersects the normal direction D of the surface 10*b* at an angle of $\theta_2$. In other words, in the scanning process b, the surface 10*c* is a head-facing area to which the ink 80 is discharged in a state of facing straight toward the printhead 110 and the surface 10*b* is a non-head-facing area to which the ink 80 is discharged without facing straight toward the printhead 110.

In this manner, the head-facing areas on the printing medium 10 in the scanning process a and the scanning process b are different from each other. In other words, in the printing method according to this embodiment, the head-facing areas are differentiated from each other in the respective times of scanning processes. This may be achieved by the medium angle control unit 133 by controlling the medium angle adjusting unit 120 on the basis of the data indicating the shape of the printing medium 10 memorized in the printing medium data memory 135 and causing the printing medium 10 to rotate during the consecutive two times of scanning processes (head-facing area changing process). For example, in a period between the scanning process a and the scanning process b, the medium angle control unit 133 may control the medium angle adjusting unit 120 to rotate the printing medium 10 counterclockwise by 90° in FIG. 1A and FIG. 1B.

Here, the ink 80 is discharged also in the scanning process b to the surface 10*b* as the non-head-facing area to which the ink 80 is discharged in the scanning process a as the non-head-facing area. In this manner, in the printing method according to this embodiment, the ink 80 is discharged to a non-head-facing area to which the ink 80 is discharged without facing the non-head-facing area straight toward the printhead 110 in any of the scanning processes without facing straight toward the printhead 110 also in other one or more times of scanning processes. In other words, in the printing method according to this embodiment, the ink is discharged in two or more scanning processes for an area which corresponds to the non-head-facing area (hereinafter, referred also simply to as non-head-facing area) in any of the scanning processes.

Accordingly, the ink coating having the predetermined film thickness $T_0$ is formed successfully in the non-head-facing area. For example, as illustrated in FIG. 1A and FIG. 1B, the total film thickness of the ink coatings 11 and 12 formed on the surface 10*b* may be equalized to the film thickness of the ink coating 11 formed on the surface 10*a* and the film thickness of the ink coating 12 formed on the surface 10*c*. The reason is as follows.

First of all, when the discharged amount of the ink 80 is the same, the film thickness of the ink coating formed in the non-head-facing area is smaller than the film thickness of the ink coating formed in the head-facing area. It is because the non-head-facing area is inclined with respect to the discharging direction of the ink 80, the surface area in which the ink 80 lands becomes wider than the head-facing area. Here, according to the above-described configuration, since the ink is discharged in two or more scanning processes for the non-head-facing area, the ink coating having the predetermined film thickness $T_0$ may be formed successfully in the same manner as the head-facing area while avoiding the film thickness of the ink coating formed in the corresponding area from becoming thinner.

Here, only by simply discharging the ink to the non-head-facing area in the two or more times of scanning processes, there may be a case where the film thickness of the ink coating formed in the non-head-facing area may exceed the predetermined film thickness $T_0$ in contrast. Therefore, the discharge control unit 131 preferably adjusts the amount of the ink 80 discharged in the non-head-facing area in at least one of the scanning processes so that the total film thickness of the ink coating formed in the non-head-facing area becomes equal to the film thickness of the ink coating to be formed on the head-facing area.

In the embodiment, the discharge control unit 131 sets the discharging amount of the ink 80 as described below. In other words, when the ink 80 is discharged to one point in the non-head-facing area in the n times (n is integers of 2 or larger) of the scanning process, the discharge amount $D_i$ of the ink 80 to be discharged to the point in the i-th scanning process is set so as to satisfy the following expression (2)

$$D_i = k_i \times D_0 \tag{2}$$

(where $D_0$ denotes the amount of the ink 80 to be discharged to one point in the head-facing area in the respective scanning processes) by using a coefficient of adjustment k set so as to satisfy the following expression (1)

[Expression 2]

$$\sum_{i=1}^{n} (k_i \cos\theta_i) = 1 \tag{1}$$

(where $\theta_i$ is an angle smaller than 90°, and indicates an angle formed between a discharging direction of the ink 80 in the above-described i-th scanning process among the n times of the scanning process and a normal direction of the printing medium 10 at that time point.). Accordingly, the total film thickness of the ink coating to be formed in the non-head-facing area may be equalized to the predetermined film thickness $T_0$, which is the same as the film thickness of the ink coating to be formed on the head-facing area.

The discharge control unit 131 does not have to perform adjustment of the ink discharging amount necessarily in all of the scanning processes from among the above-described n times of the scanning processes. In other words, adjustment does not have to be performed (the discharging amount with respect to the non-head-facing area may be the same discharging amount with respect to the head-facing area) in some of the scanning processes. In such a case, the coefficient of adjustment k in the corresponding scanning process may be set to "1".

Also, the discharge control unit 131 may calculate the above-described θi from data indicating the shape of the printing medium 10 acquired from the printing medium data memory 135, or may acquire θi directly from the printing medium data memory 135.

According to the printing method of this embodiment, since the ink 80 is discharged to the non-head-facing area in the two or more times of the scanning processes, the amount of the ink 80 to be discharged to the non-head-facing area may be set to be smaller than the amount of the ink 80 to be discharged to the head-facing area in at least one of the above-described scanning process. In particular, by reducing the amount of the ink 80 to be discharged to the non-head-facing area to be smaller than the amount of the ink 80 to be discharged to the head-facing area in all of the scanning processes, the ink coating having the predetermined film thickness $T_0$ may be formed in the non-head-facing area without increasing the ink 80 to be discharged from the printhead 110.

In the printing method of this embodiment, scanning with the printhead 110 is preferably performed so as to transverse the head-facing area and the non-head-facing area as the scanning process a and the scanning process b in at least one of the scanning processes. Accordingly, printing time may be reduced since the head-facing area and the non-head-facing area may be printed in one scanning processes.

Here, adjustment of the discharging amount of the ink 80 to the non-head-facing area by the discharge control unit 131 will be described in detail. FIGS. 2A to 2H are drawings illustrating examples of amounts of application of ink in non-head-facing areas. As illustrated in FIG. 2A to FIG. 2H, adjustment of the discharging amount of the ink 80 to the non-head-facing area may be performed in various modes. The adjustment of the discharging amount of the ink 80 to the non-head-facing area is not limited to the modes exemplified in FIG. 2A to FIG. 2H as long as the above-described conditions are satisfied. Also, the same adjustment may be performed for all of the non-head-facing areas and adjustments in modes different from each other may be performed therefor.

Figure 2:
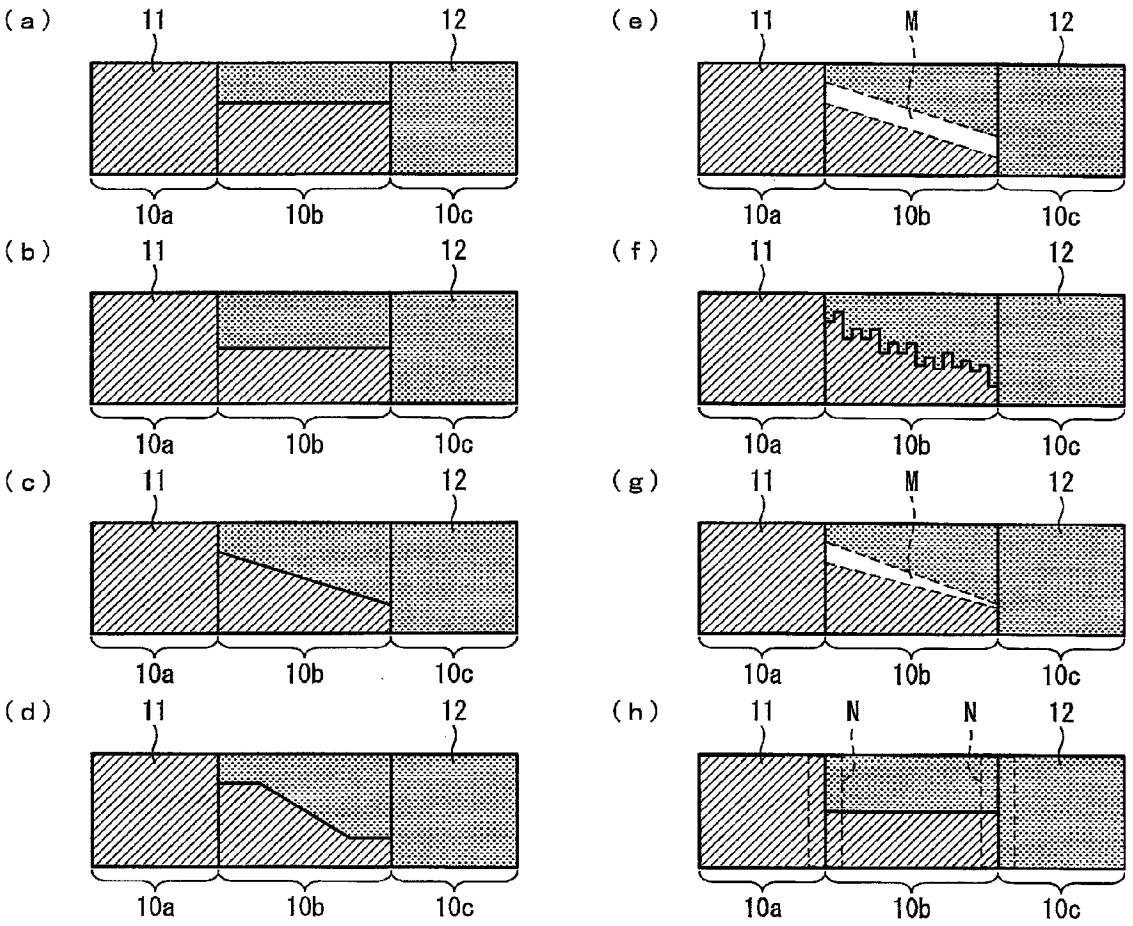
FIGS. 2A to 2H are drawings illustrating examples of amounts of application of ink in non-head-facing areas in the printing method according to the embodiment of the present invention.

In the example illustrated in FIG. 2A, the same amount of the ink 80 is discharged to the surface 10*a* (head-facing area) and the surface 10*b* (non-head-facing area, first area) in the scanning process a (type 1 scanning process), and the ink 80 of a smaller amount than to the surface 10*c* (head-facing area) is discharged to the surface 10*b* (non-head-facing area) so that the total film thickness of the ink coatings 11 and 12 formed on the surface 10*b* becomes the predetermined film thickness $T_0$ in the scanning process b (type 2 scanning process).

In this case, in the scanning process a, the ink coating 11 to be formed on the surface 10*b* is thinner than the ink coating 11 to be formed on the surface 10*a*. It is because the surface area to be printed by the ink 80 droplets is larger than the surface 10*a* to be in a state of facing straight toward the printhead 110 because the surface 10*b* is printed in a state not to face straight toward the printhead 110. Therefore, by forming additionally the ink coating 12 on the surface 10*b* in the scanning process b, the total film thickness of the ink coatings 11 and 12 to be formed on the surface 10*b* may be set to the predetermined film thickness $T_0$.

An ink amount $D_2$ to be discharged on the surface 10*b* in the scanning process b is obtained as $$D_2=(1-\cos\theta_1)/\cos\theta_2\times D_0 \quad (3)$$

by assigning n=2, $k_i$=1 to above-described Expression (1) and Expression (2), for example.

Here, since the ink 80 to be discharged from the front in the scanning process a occupies a larger ratio in the ink 80 discharged to the surface 10*b* when the printing medium 10 is observed mainly with the surface 10*a* oriented to the front, the printed image quality of the surface 10*b* when observing from the front may be improved.

It is also possible to discharge the same amount of ink 80 to the surface 10*c* and the surface 10*b* in the scanning process b and adjust the amount of ink 80 to be discharged in the surface 10*b* in the scanning process a. This is specifically preferable in a case where the printing medium 10 is observed with the surface 10*c* oriented to the front.

In the example illustrated in FIG. 2B, the amount of the ink 80 to be discharged to the surface 10*b* (second area) is adjusted in the scanning process a and the scanning process b (type 3 scanning process) so that the film thicknesses of the ink coatings 11 and 12 to be formed on the surface 10*b* in the scanning process a and the scanning process b (type 3 scanning process) are the same, and the total film thickness of the ink coatings 11 and 12 to be formed on the surface 10*b* becomes the predetermined film thickness $T_0$.

The ink amounts $D_1$ and $D_2$ to be discharged on the surface 10*b* in the scanning process a and the scanning process b may be obtained by assigning n=2, $k_1 \cos\theta_1=k_2 \cos\theta_2$ to the above-described Expressions (1) and (2) as $$D_1=D_0/2\cos\theta_1 \quad (4)$$

$$D_2=D_0/2\cos\theta_2 \quad (5).$$

Here, in the case where the printing medium 10 is observed from various directions (for example, directions facing straight toward the surface 10*a* and the surface 10*c*), since the film thicknesses of the ink coating to be formed on the surface 10*b* in the respective scanning processes are uniform. Therefore, such an event that the printed image quality of the surface 10*b* is deteriorated when observing from a certain direction is suppressed.

Subsequently, examples illustrated in FIG. 2C and FIG. 2D will be described. In this example, in the scanning process a (type 4 scanning process), the discharge control unit 131 controls the amount of ink 80 to be discharged to a boundary between the surface 10*a* (head-facing area) and the surface 10*b* (third area) to be the same amount as the amount of the ink 80 to be discharged to the surface 10*a*, and changes the discharging amount of the ink 80 continuously from the boundary to the surface 10*b*. More specifically, the discharge control unit 131 changes the discharging amount of the ink 80 continuously from the above-described boundary to the surface 10*b* so as to decrease as it goes farther from the boundary.

In this manner, by discharging the same amount of ink 80 as the surface 10*a* to the boundary between the surface 10*a* and the surface 10*b*, continuity of printing between the surface 10*a* and the surface 10*b* is secured, so that the printed image quality is improved.

In the same manner, in the scanning process b (type 4 scanning process), the discharge control unit 131 controls the amount of ink 80 to be discharged to a boundary between the surface 10*c* (head-facing area) and the surface 10*b* (third area) to be the same amount as the amount of the ink 80 to be discharged to the surface 10*c*, and changes the discharging amount of the ink 80 continuously from the boundary to the surface 10*b*. More specifically, the discharge control unit 131 changes the discharging amount of the ink 80 continuously from the above-described boundary to the surface 10*b* so as to decrease as it goes farther from the boundary. Accordingly, in the same manner, continuity of printing between the surface 10*c* and the surface 10*b* is secured, so that the printed image quality is improved.

Also, in the scanning process a and the scanning process b, since the discharging amount of the ink 80 is continuously changed from the above-described boundary to the surface 10*b*, the discharging amount of the ink 80 may be adjusted so that portions to which the same amount of the ink 80 as the head-facing area (surfaces 10*a* and 10*c*) is discharged do not overlap with each other and an ink coating having the predetermined total film thickness $T_0$ is formed on the surface 10*b*. In particular, it is preferable to change the discharging amount of the ink 80 continuously from the above-described boundary to the surface 10*b* so as to decrease as it goes farther from the boundary.

Also, the head-facing area is closer to the printhead than the non-head-facing area. Therefore, by setting the ink discharging amount on the boundary with respect to the head-facing area to be large in the surface 10*b* as described above, a large amount of the ink 80 is discharged in a state of being closer to the printhead 110, and hence the image quality in the surface 10*b* is improved.

A portion where the ink discharging amount is to be changed may extend over the entire part of the surface 10*b* as illustrated in FIG. 2C, or may be limited to part of the surface 10*b* depending on a pattern or the like to be printed as illustrated in FIG. 2D. Also, the ink discharging amount changing modes in the respective scanning processes are preferably changed so as to correspond to each other.

Subsequently, examples illustrated in FIG. 2E to FIG. 2G will be described. In this example, in the scanning process a (type 5 scanning process), the discharge control unit 131 controls the amount of ink 80 to be discharged to a boundary between the surface 10*a* (head-facing area) and the surface 10*b* (fourth area) to be the same amount as the amount of the ink 80 to be discharged to the surface 10*a*, and changes the discharging amount of the ink 80 unevenly from the boundary to the surface 10*b*. More specifically, the discharge control unit 131 changes the discharging amount of the ink 80 from the above-described boundary to the surface 10*b* so as to vary within a range indicated by reference sign M in FIG. 2E and FIG. 2G (varies for example as illustrated in FIG. 2F).

In this manner, by discharging the same amount of ink 80 as the surface 10*a* to the boundary between the surface 10*a* and the surface 10*b*, continuity of printing between the surface 10*a* and the surface 10*b* is secured, so that the printed image quality is improved.

In the same manner, in the scanning process b (type 5 scanning process), the discharge control unit 131 controls the amount of ink 80 to be discharged to a boundary between the surface 10*c* (head-facing area) and the surface 10*b* (fourth area) to be the same amount as the amount of the ink 80 to be discharged to the surface 10*c*, and changes the discharging amount of the ink 80 unevenly so as to correspond to the scanning process a from the boundary to the surface 10*b*. Accordingly, in the same manner, continuity of printing between the surface 10*c* and the surface 10*b* is secured, so that the printed image quality is improved.

Here, as described above, by changing the amount of the ink 80 to be discharged unevenly from the above-described boundary to the surface 10*b*, occurrence of the unevenness which can be generated when repeating the plurality of times of printing may be preferably suppressed.

As a method of changing the ink discharging amount unevenly, for example, a method of setting a displacement width such as the range indicated by the reference sign M in FIG. 2E and FIG. 2G, and adding a noise so as to cause the fluctuation within the displacement width may be used.

Also, in the same manner as the examples illustrated in FIG. 2C and FIG. 2D, the discharging amount of the ink 80 may be adjusted so that portions to which the same amount of the ink 80 as the head-facing area (surfaces 10*a* and 10*c*) is discharged do not overlap with each other and an ink coating having the predetermined total film thickness $T_0$ is formed on the surface 10*b* in these examples as well. Also, in this example, in the same manner as the examples illustrated in FIG. 2C and FIG. 2D, by increasing the ink discharging amount at the boundary with respect to the head-facing area in the surface 10*b*, the image quality of the surface 10*b* may be improved. Also, in the same manner as the examples illustrated in FIG. 2C and FIG. 2D, in these examples as well, a portion where the ink discharging amount is to be changed may extend over the entire part of the surface 10*b* as illustrated in FIG. 2C, or may be limited to part of the surface 10*b* depending on a pattern or the like to be printed as illustrated in FIG. 2D.

Also, in the respective scanning processes, when scanning across the head-facing area and the non-head-facing area transversely and the amount of the ink 80 to be discharged in the printing medium 10 at the time is changed between the non-head-facing area and the head-facing area (for example, examples illustrated in FIG. 2A and FIG. 2B), positions where the discharging amount of the ink 80 is changed may be varied.

In other words, as indicated by reference sign N in FIG. 2H, by varying the position where the ink discharging amount is changed between the surface 10*a* and the surface 10*b* in the scanning process a and the position where the ink discharging amount is changed between the surface 10*c* and the surface 10*b* in the scanning process b, a seam between the surface 10*a* and the surface 10*b* and a seam between the surface 10*c* and the surface 10*b* are blurred to make the seams less noticeable, so that an unpleasant sensation may be resolved.

As a method of varying the position where the ink discharging amount is to be changed, for example, known image processing technologies such as dither methods such as ordered dither or random dither, error diffusion, noise addition or the like may be applied.

Another Embodiment

Figure 3:
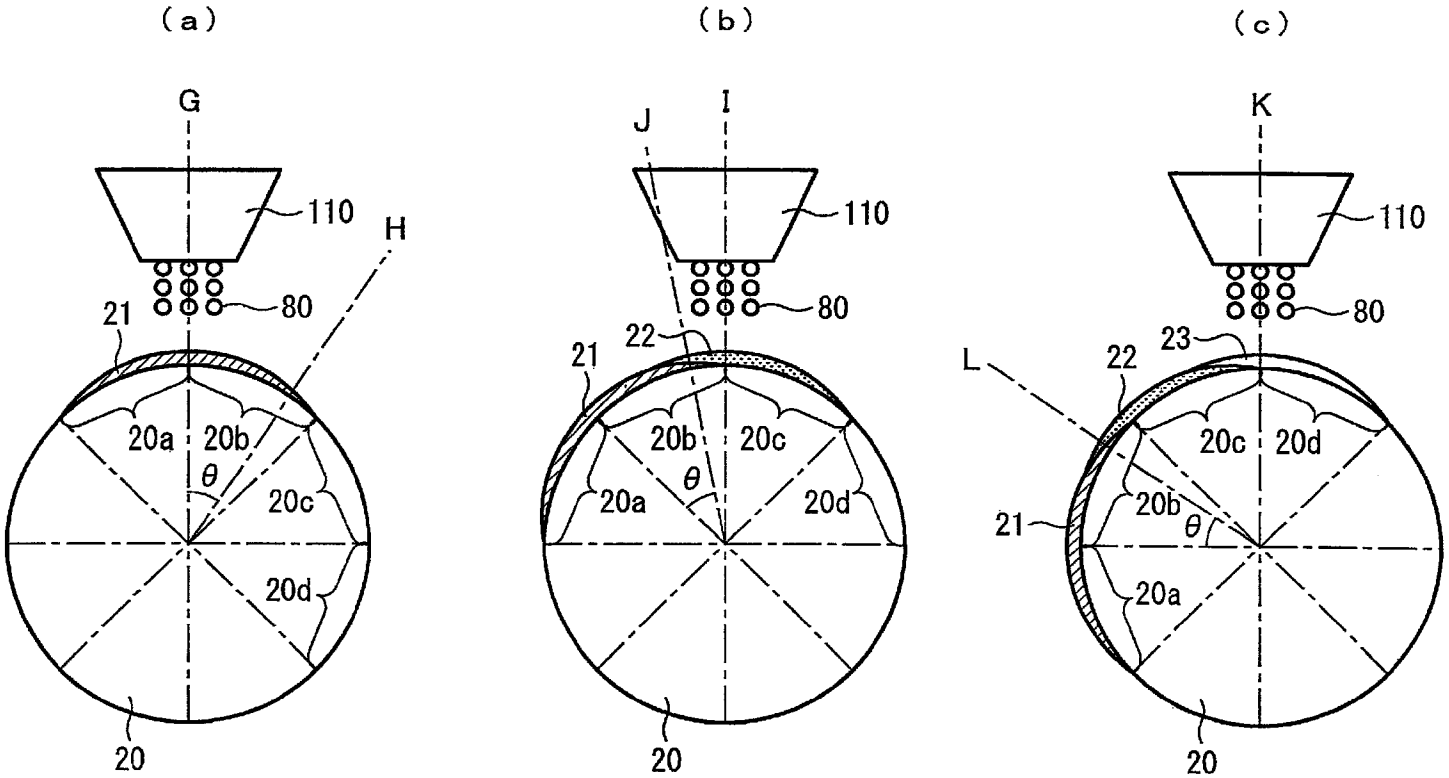
FIGS. 3A and 3C are drawings schematically illustrating some processes of a printing method according to an embodiment of the present invention.

Also, the printing medium may be a solid bounded by curved surface. FIGS. 3A to 3C are drawings schematically illustrating some processes of a printing method according to another embodiment of the present invention. As illustrated in FIGS. 3A to 3C, a case of printing on a printing medium 20, which is a solid bounded by curved surface, will be described in this embodiment.

In this embodiment, a curved surface of the solid bounded by curved surface is divided and the respective divided surfaces are printed from two or more directions. For example, when printing on the printing medium 20, a side surface of the printing medium 20 is divided into areas 20*a* to 20*d*, and an ink coating having the predetermined film thickness $T_0$ is formed in each of the areas by a scanning process a in which a boundary between the area 20*a* and the area 20*b* faces straight toward the printhead 110 and printing is performed in the area 20*a* and the area 20*b* as the non-head-facing areas, a scanning process b in which a boundary between the area 20*b* and the area 20*c* faces straight toward the printhead 110 and printing is performed in the area 20*b* and the area 20*c* as the non-head-facing areas, and a scanning process c in which a boundary between the area 20*c* and the area 20*d* faces straight toward the printhead 110 and printing is performed in the area 20*c* and the area 20*d* as the non-head-facing areas. Accordingly, for example, printing time may be reduced in comparison with a case where printing is performed with the entire side surface faced straight toward the front of the printhead 110 while the printing medium 20 is rotated.

In this embodiment, a case where the printing medium 20 is a column having a bottom surface as illustrated in FIG. 3A to FIG. 3C, and the printhead 110 in a case where the scanning direction is a depth direction of the paper plane and a horizontal direction of the paper plane in the drawings of FIG. 3A to FIG. 3C will be described. The side surface of the printing medium 20 is divided into eight areas including the areas 20*a* to 20*d* by every center angle 45°.

FIG. 3A to FIG. 3C are drawings schematically illustrating the scanning process a to the scanning process c. As illustrated in FIG. 3A to FIG. 3C, the discharge control unit 131 and the scanning control unit 132 control the printhead 110 to discharge the ink 80 to adjacent areas in a state in which a boundary between the adjacent areas face straight toward the printhead 110, and forms the ink coatings 21 to 23. Also, during two consecutive scanning processes, the medium angle control unit 133 controls the medium angle adjusting unit 120 to rotate the printing medium 20 counterclockwise by 45° in FIG. 3A to FIG. 3C. By performing the procedure described above until the printing medium 20 makes one turn, the ink is discharged to all of the areas on the printing medium 20 including the areas 20*a* to 20*d* during the two times of scanning processes, so that the ink coating whose total film thickness is the predetermined film thickness $T_0$ can be formed.

In the respective scanning process, the discharging amount of the ink 80 with respect to the non-head-facing area is adjusted so that the total film thickness becomes the predetermined film thickness $T_0$ as described above. More specifically, the discharge control unit 131 adjusts the discharging amount of the ink 80 as described below, for example, with respect to the point where a line H is positioned in the area 20*b* in FIG. 3A.

First of all, in the scanning process a illustrated in FIG. 3A, a film thickness $N_{rab}$ of the ink coating 21 formed at the above-described point is obtained as below.

$$N_{rab}=N_0 \cos\theta \tag{6}$$

(where $N_0$ is a film thickness of the ink coating 21 formed on a boundary (head-facing area) between the area 20*a* and the area 20*b*, and 8 is an angle between the discharging direction G of the ink 80 and the line H.

Also, in the scanning process b illustrated in FIG. 3B, since the above-described point is rotated by 45° and hence is positioned on a line J at an angle of 45°−θ with the discharging direction I of the ink 80, and the film thickness $N_{rbc}$ of the ink coating 22 to be formed on the above-described point is obtained as follows.

$$N_{rbc}=N_0 \cos(45°-\theta) \tag{7}$$

Therefore, in order that the total film thickness at the above-described point has the same film thickness as that formed on the head-facing area, coefficient of adjustments $k_1$ and $k_2$ may be set so as to satisfy $$k_1N_{rab}+k_2N_{rbc}=N_0 \tag{8}$$

in other words, $$k_1N_0 \cos(45°-\theta)+k_2N_0 \cos\theta=N_0 \tag{9}.$$

It is preferable that the value of $N_0$ is equal to the predetermined film thickness $T_0$. Also, the relationship between the coefficient of adjustment k and the ink discharging amount $D_i$ is as shown in Expression (2).

In another embodiment, printing of the respective divided surfaces of the column may be performed from the direction n (n>2). When the ink 80 is discharged to one point in n times of the scanning processes, and an angle between the discharging direction of the ink 80 in the i-th scanning process and the normal direction of the printing medium 20 at the corresponding one point is expressed by $\theta_i$, the coefficient of adjustment $k_1, k_2, \ldots k_n$ may be set so as to satisfy $$k_1N_0 \cos\theta_1+k_2N_0 \cos\theta_2+\ldots+k_nN_0 \cos\theta_n=N_0 \tag{10}.$$

In this embodiment as well, as illustrated in FIG. 2A to FIG. 2H, adjustment of the discharging amount of the ink 80 to the non-head-facing area may be performed in various modes.

Still Another Embodiment

Figure 4:
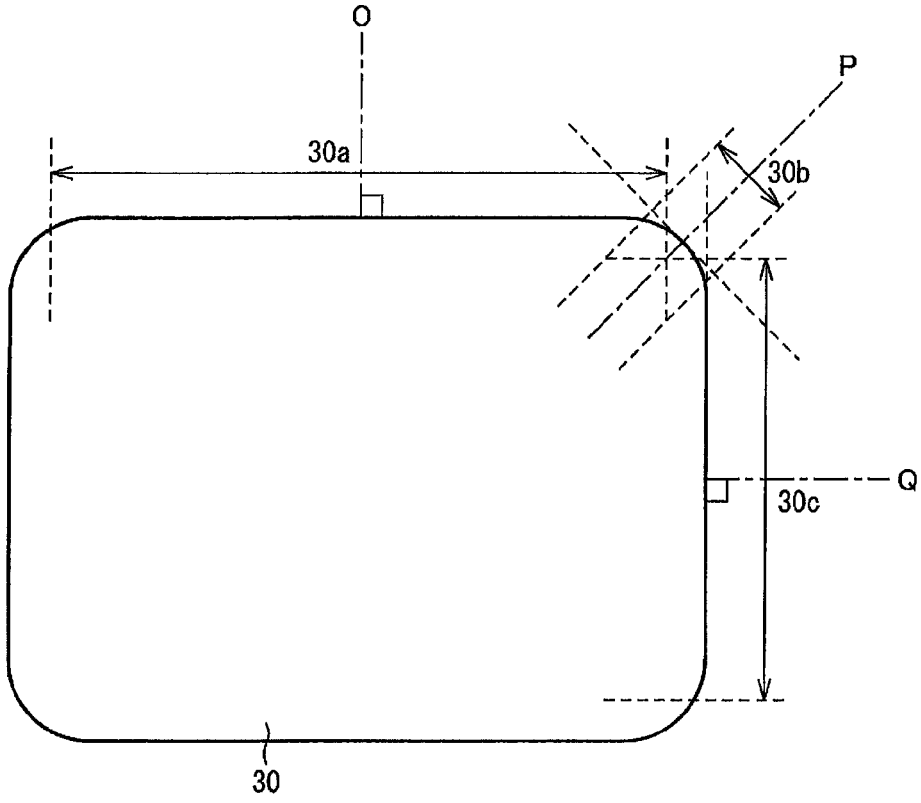
FIG. 4 is a drawing for explaining an example of the printing method according to the embodiment of the present invention.

FIG. 4 is a drawing for explaining a case where printing on a printing medium 30 having a quadrangular prism shape rounded at corners by using a printing method according to an embodiment of the present invention. As illustrated in FIG. 4, the printing method of this embodiment includes a scanning process a in which the ink 80 is discharged to an area 30*a* from a direction O, a scanning process b in which the ink 80 is discharged to an area 30*b* from a direction P, and a scanning process c in which the ink 80 is discharged to an area 30*c* from a direction Q.

In this manner, printing may be performed with end surfaces at corners of the quadrangular prism faced straight toward the printhead 110. The printing method of this embodiment is preferable when the end surfaces of the corners are too long to print from two directions (directions O and Q), and the image quality may be improved by preventing occurrence of landing failure of the ink droplets. The smaller the ink droplet size, the shorter the distance in which the landing failure occurs. Therefore, the printing method of this embodiment may be applied in accordance with the performance of the printhead 110, the scanning speed, and characteristics (for example, mass) or the like of the ink 80. When the end surface is still larger, the end surface portion may be divided into a plurality of areas for printing.

<Additional Statements>

As described above, the printing method according to the embodiment of the present invention includes: a plurality of times of a scanning process including scanning with a printhead 110 for ink jet printing and discharging the ink 80 to a printing medium (for example, the printing medium 10, the printing medium 20, and the like) from the printhead 110, and includes: differentiating the head-facing areas to which the ink 80 is discharged in a state of facing straight toward the printhead 110 (for example, the surface 10*a* in FIG. 1A, the surface 10*c* in FIG. 1B, the boundary between the area 20*a* and the area 20*b* in FIG. 3A, the boundary between the area 20*b* and the area 20*c* in FIG. 3B, and the boundary between the area 20*c* and the area 20*d* in FIG. 3C) from each other in the respective scanning processes, discharging the ink 80 to a non-head-facing area to which the ink 80 without facing the non-head-facing area straight toward the printhead 110 in any of the scanning processes (for example, the surface 10*b* in FIG. 1A, the surface 10*b* in FIG. 1B, the area 20*a* and the area 20*b* (except for the boundary) in FIG. 3A, the area 20*b* and the area 20*c* (except for the boundary) in FIG. 3B, the area 20*c* and the area 20*d* (except for the boundary) in FIG. 3C, and the like) without facing the non-head-facing area straight toward the printhead 110 also in other one or more scanning processes, and adjusting the amount of the ink 80 to be discharged to the non-head-facing area in at least one of the scanning processes so that the total film thickness of the coating formed in the non-head-facing area (for example, the ink coatings 11, 12, and 21 to 23, and the like) becomes a predetermined film thickness $T_0$.

According to the above-described configuration, the ink 80 is discharged to the area which corresponds to the non-head-facing area in any of the scanning processes to each of areas in two or more times of the scanning processes. Therefore, the film thickness of the ink coating to be formed in the non-head-facing area is prevented from becoming thinner than the head-facing area.

In addition, according to the above-described configuration, since all of the surfaces of the printing medium are not faced straight toward the printhead 110 for printing, an operation for differentiating areas facing straight toward the printhead 110 in the respective scanning processes (the positioning action between the printhead 110 and the printing medium) can be reduced in comparison with the case where all of the surfaces of the printing medium are faced straight toward the printhead 110 for printing, so that the printing time may be reduced.

In the above-described configuration, unlike the technology disclosed in PTL 1, a specific mechanism for improving the resolution or increasing the ink discharging amount (for example, a highly precise head scanning mechanism or the like) is not necessary.

As described above, according to the above-described configuration, the ink coating having a predetermined film thickness $T_0$ is formed on a surface of a printing medium having a three-dimensional structure in shorter time.

Also, the amount of the ink 80 to be discharged in the non-head-facing area is adjusted so that the total film thickness of the coating of the ink 80 formed in the non-head-facing area becomes equal to the film thickness of the coating of the ink 80 formed on the head-facing area in the above-described at least one of the scanning processes.

Accordingly, the ink coating having the same film thickness as the head-facing area may be formed also in the non-head-facing area.

Also, the amount of the ink 80 to be discharged in the non-head-facing area is adjusted to be smaller than the amount of ink 80 to be discharged to the head-facing area in at least one of the scanning processes.

In the above-described configuration, by reducing the amount of ink 80 to be discharged in the non-head-facing area to an amount smaller than the amount of ink 80 to be discharged in the head-facing area in at least one of the scanning processes and discharging the ink 80 to the non-head-facing area in two or more times of the scanning process, the ink coating having the predetermined film thickness $T_0$ may be successfully formed in the non-head-facing area.

Also, the ink 80 is discharged to one point in the non-head-facing area in the n times (n is integers of 2 or larger) of the scanning process, the above-described amount $D_i$ of the ink to be discharged to the point in the i-th scanning process is set so as to satisfy the following expression (2)

$$D_i = k_i \times D_0 \tag{2}$$

(where $D_0$ denotes the amount of the ink 80 to be discharged to one point in the head-facing area in the respective scanning processes) by using a coefficient of adjustment k set so as to satisfy the following expression (1)

[Expression 3]

$$\sum_{i=1}^{n} (k_i \cos\theta_i) = 1 \tag{1}$$

(where $\theta_i$ is an angle smaller than 90°, and indicates an angle formed between a discharging direction of the ink 80 in the above-described i-th scanning process among the n times of the scanning process and a normal direction of the printing medium at that time point.).

In the above-described configuration, since the discharging amount of the ink 80 with respect to one point of the non-head-facing area may be preferably adjusted so that the film thickness of the ink coating to be formed on one point of the non-head-facing area becomes the same as the film thickness of the ink coating to be formed in the head-facing area, the ink coating having the predetermined film thickness $T_0$ may be successfully formed on the surface of the printing medium.

Also, scanning with the printhead 110 is performed so as to transverse the head-facing area and the non-head-facing area in the at least one of the scanning processes.

In the above-described configuration, since the scanning with the printhead 110 is performed so as to transverse the head-facing area and the non-head-facing area, both of the head-facing area and the non-head-facing area can be scanned in one time of the scanning process without performing the positioning action between the printhead 110 and the printing medium. Accordingly, the number of times of the positioning operations may be reduced, and hence the printing time may be reduced.

For example, when printing on side surfaces 10*a* to 10*c* of a printing medium 10 having a polygonal column shape as illustrated in FIG. 1A and FIG. 1B with all the surfaces faced straight toward the printhead 110, the positioning action between the printhead 110 and the printing medium 10 is increased and the printing time is increased. However, according to the above-described configuration, for example, what is necessary is only that the side surfaces are faced straight toward the printhead 110 alternately (10*a* and 10*c*) and that the intermediate surface 10*b* is printed as the non-head-facing areas, and hence the positioning action between the printhead 110 and the printing medium 10 is reduced, and hence the printing time may be reduced.

Also, for example, when printing on side surfaces of a printing medium 20 having a column shape as illustrated in FIG. 3A to FIG. 3C so as to be faced straight toward the printhead 110, the positioning action between the printhead 110 and the printing medium 20 is very much increased and the printing time is increased. However, according to the above-described configuration, for example, what is necessary is only that the side surface is divided into a plurality of areas in the circumferential direction, and that the respective divided surfaces are printed in two or more scanning processes, and hence the positioning action between the printhead 110 and the printing medium 20 is reduced, and the printing time may be reduced.

Also, a configuration in which the ink 80 is discharged to a first area, which is part of the printing medium, without facing the first area straight toward the printhead 110, in two or more times of the scanning process, the two or more times of the scanning process includes one time of type 1 scanning process and one or more times of type 2 scanning process, the same amount of ink 80 as the amount to be discharged to the head-facing area is discharged to the first area in the type 1 scanning process, and an amount of ink 80 smaller than the amount to be discharged to the head-facing area is discharged to the first area in the type 2 scanning process is also applicable.

In the above-described configuration, since the same amount of ink 80 is discharged to the head-facing area and the first area in the type 1 scanning process, the film thickness of the ink coating to be formed in the first area in the type 1 scanning process is thinner than the film thickness of the ink coating formed in the head-facing area. However, since the ink 80 is further applied to the first area in the type 2 scanning process, the ink coating having the predetermined film thickness $T_0$ may be formed in the first area.

Here, since the ink 80 to be discharged in the same scanning process as the head-facing area occupies a larger ratio in the ink 80 discharged to the first area in the above-described configuration when the printing medium is observed mainly with head-facing area in the type 1 scanning process oriented to the front, the printed image quality in the first area when observing from the front may be improved.

Also, a configuration in which the ink 80 is discharged to a second area, which is part of the printing medium, without facing the second area straight toward the printhead 110, in two or more times of the scanning processes, the two or more times of the scanning process includes two or more times of type 3 scanning process, and the ink 80 is discharged so that ink coatings having the same film thickness are formed in the second area in the respective times of the type 3 scanning process is also applicable.

In the above-described configuration, by discharging the ink 80 to the second area so that the film thicknesses of the ink coatings to be formed in the second area in the respective processes are the same and the total film thickness to be formed has a predetermined film thickness $T_0$ in two times or more of the type 3 scanning process, the ink coating having the predetermined film thickness $T_0$ may be successfully formed on the surface of the printing medium.

Here, in a case where the printing medium is observe from various directions, according to the above-described configuration, since the film thicknesses of the ink coating to be formed in the second area in the respective third scanning processes are uniform, such an event that the printed image quality in the second area is deteriorated when observing from a certain direction is suppressed.

Also, the ink 80 is discharged to a third area, which is part of the printing medium, without facing the third area straight toward the printhead 110 in two or more times of the scanning processes, the two or more times of the scanning process includes two or more times of type 4 scanning process, scanning with the printhead 110 is performed so as to transverse the third area and the head-facing area in the respective type 4 scanning processes, the same amount of ink 80 as the amount to be discharged to the head-facing area is discharged to a boundary between the third area and the head-facing area, and the amount of ink 80 to be discharged is continuously changed from the boundary to the third area.

According to the above-described configuration, in the type 4 scanning process, by discharging the same amount of the ink 80 as that in the head-facing area to a boundary between the head-facing area and the third area which are continuously printed, continuity of printing between the head-facing area and the third area is secured, so that the printed image quality is improved.

Here, when the areas to which the same amount of ink 80 as the head-facing area is discharged overlap in the third area between the plurality of type 4 scanning processes, the total film thickness of the ink coating to be formed in the third area may exceed the predetermined film thickness $T_0$. However, since the head-facing areas in the respective type 4 scanning processes are different from each other, boundaries between the head-facing area and the third area are also different. In addition, since the amount of ink 80 to be discharged is continuously changed from the above-described boundary to the third area, the portions to which the same amount of ink 80 as the head-facing area is discharged do not overlap in the respective type 4 scanning processes, and the discharging amount of the ink 80 may be adjusted so that the ink coating having the predetermined total film thickness $T_0$ is formed in the third area.

Also, the head-facing area is closer to the printhead 110 than the non-head-facing area. Therefore, as described above, by setting the ink discharging amount on the boundary with respect to the head-facing area to be large in the third area, a large amount of the ink 80 is discharged in a state of being closer to the printhead 110, and hence the image quality in the third area is improved.

A portion where the ink discharging amount is to be changed may extend over the entire part of the third area, or may be limited to part of the third area depending on a pattern or the like to be printed.

Also, the ink 80 is discharged to a fourth area, which is part of the printing medium, without facing the fourth area straight toward the printhead 110 in two or more times of the scanning processes, the two or more times of the scanning process includes two or more times of type 5 scanning process, scanning with the printhead 110 is performed so as to transverse the fourth area and the head-facing area in the respective type 5 scanning processes, the same amount of ink 80 as the amount to be discharged to the head-facing area is discharged to a boundary between the fourth area and the head-facing area, and the amount of ink 80 to be discharged is unevenly changed from the boundary to the fourth area.

According to the above-described configuration, in the type 5 scanning process, by discharging the same amount of the ink 80 as that in the head-facing area to a boundary between the head-facing area and the fourth area which are continuously printed, continuity of printing between the head-facing area and the fourth area is secured, so that the printed image quality is improved.

Here, when the areas to which the same amount of ink 80 as the head-facing area is discharged overlap in the fourth area between the plurality of type 5 scanning processes, the total film thickness of the ink coating to be formed in the fourth area may exceed the predetermined film thickness $T_0$. However, since the head-facing areas in the respective type 5 scanning processes are different from each other, boundaries between the head-facing area and the fourth area are also different. In addition, since the amount of ink 80 to be discharged is unevenly changed from the above-described boundary to the fourth area, the portions to which the same amount of ink 80 as the head-facing area is discharged do not overlap in the respective type 5 scanning processes, and the discharging amount of the ink 80 may be adjusted so that the ink coating having the predetermined total film thickness $T_0$ is formed in the fourth area.

In addition, according to the above-described configuration, by changing the amount of the ink 80 to be discharged unevenly from the above-described boundary to the fourth area, occurrence of the unevenness which can be generated when repeating the plurality of times of printing may be preferably suppressed. As a method of changing the ink discharging amount unevenly, for example, a method of setting a displacement width to cause the fluctuation within the displacement width may be used.

Also, the head-facing area is closer to the printhead 110 than the non-head-facing area. Therefore, as described above, by setting the ink discharging amount on the boundary with respect to the head-facing area to be large in the fourth area, a large amount of the ink 80 is discharged in a state of being closer to the printhead 110, and hence the image quality in the fourth area is improved.

Also, when scanning with the printhead 110 is performed so as to transverse the head-facing area and the non-head-facing area and the amount of the ink 80 to be discharged on the printing medium is changed between the head-facing area and the non-head-facing area in the scanning process, positions where the amount of the ink 80 is changed may be varied.

In the above-described configuration, since the position where the discharging amount of the ink 80 is changed between the head-facing area and the non-head-facing area varies, a seam between the head-facing area and the non-head-facing area may be blurred, so that an unpleasant sensation may be resolved.

Also, a printing apparatus 100 according to an embodiment of the present invention includes: a printhead 110 for ink jet printing; discharge control unit 131 and the scanning control unit 132 configured to control the printhead 110 to perform a scanning process in which ink 80 is discharged from the printhead 110 to the printing medium while scanning with the printhead 110 by a plurality of times; and the medium angle adjusting unit 120 and the medium angle control unit 133 configured to differentiate head-facing areas to which the ink 80 is discharged in a state of facing straight toward the printhead 110 from each other in the respective scanning processes, and the discharge control unit 131 and the scanning control unit 132 control the printhead 110 so that the ink 80 is discharged to a non-head-facing area, to which the ink 80 is discharged, without facing the non-head-facing area straight toward the printhead 110 also in other one or more scanning processes, and the amount of the ink 80 to be discharged in the non-head-facing area in at least one of the scanning processes is adjusted so that the total film thickness of the coating film of the ink 80 formed in the non-head-facing area becomes equal to the film thickness $T_0$ of the coating film of the ink 80 to be formed on the head-facing area.

According to the above-described configuration, the same effects and advantages as the printing method according to the present invention are achieved.

INDUSTRIAL AVAILABILITY

The present invention is applicable to a field of printing process for various articles, and a field of manufacture of the printing apparatus.

The invention claimed is:

1. A printing method comprising:

a plurality of times of a scanning process including scanning with a printhead for ink jet printing and discharging ink to a printing medium from the printhead, characterized in that including differentiating head-facing areas to which the ink is discharged in a state of facing straight toward the printhead from each other in the respective scanning processes, discharging the ink to a non-head-facing area to which the ink is discharged in a state of not facing straight toward the printhead in any of the scanning processes without facing the non-head-facing area straight toward the printhead also in other one or more scanning processes, and adjusting the amount of the ink to be discharged in the non-head-facing area in at least one of the scanning processes so that the total film thickness of the ink coating formed in the non-head-facing area becomes a predetermined film thickness, wherein when the ink is discharged to one point in the non-head-facing area in the n times (n is integers of 2 or larger) of the scanning process, an amount $D_i$ of the ink to be discharged to the point in the i-th scanning process is set so as to satisfy the following expression (2)

$$D_i = k_i \times D_0 \tag{2}$$

(where $D_0$ denotes the amount of the ink to be discharged to one point in the head-facing area in the respective scanning processes) by using a coefficient of adjustment $k_i$ set so as to satisfy the following expression (1)

[Expression 1]

$$\sum_{i=1}^{n} (k_i \cos\theta_i) = 1 \tag{1}$$

(where $\theta_i$ is an angle smaller than 90°, and indicates an angle formed between a discharging direction of the ink in the i-th scanning process among the n times of the scanning process and a normal direction of the printing medium at that time point.).

2. The printing method according to claim 1, characterized in that the amount of the ink to be discharged in the non-head-facing area is adjusted so that the total film thickness of the ink coating formed in the non-head-facing area becomes equal to the film thickness of the ink coating to be formed in the head-facing area in the at least one of the scanning processes.

3. The printing method according to claim 1, characterized in that the amount of the ink to be discharged in the non-head-facing area is adjusted to be smaller than the amount of ink to be discharged to the head-facing area in at least one of the scanning processes.

4. The printing method according to claim 1, characterized in that scanning with the printhead is performed so as to transverse the head-facing area and the non-head-facing area in the at least one of the scanning processes.

5. The printing method according to claim 1, characterized in that the ink is discharged without facing a second area, which is part of the printing medium, straight toward the printhead in two or more times of the scanning processes, the two or more times of the scanning process includes two or more times of type 3 scanning process, and the ink is discharged so that coatings of the ink having the same film thickness are formed in the second area in the respective times of the type 3 scanning process.

6. The printing method according to claim 1, characterized in that the ink is discharged to a third area, which is part of the printing medium, without facing the third area straight toward the printhead in two or more times of the scanning processes, the two or more times of the scanning process includes two or more times of type 4 scanning process, scanning with the printhead is performed so as to transverse the third area and the head-facing area in the respective type 4 scanning processes, the same amount of the ink as the amount to be discharged to the head-facing area is discharged to a boundary between the third area and the head-facing area, and the amount of the ink to be discharged is continuously changed from the boundary to the third area.

7. The printing method according to claim 1, characterized in that the ink is discharged to a fourth area, which is part of the printing medium, without facing the fourth area straight toward the printhead in two or more times of the scanning processes, the two or more times of the scanning process includes two or more times of type 5 scanning process, scanning with the printhead is performed so as to transverse the fourth area and the head-facing area in the respective type 5 scanning processes, the same amount of ink as the amount to be discharged to the head-facing area is discharged to a boundary between the fourth area and the head-facing area, and the amount of ink to be discharged is unevenly changed from the boundary to the fourth area.

8. The printing method according to claim 1, characterized in that when scanning with the printhead is performed so as to transverse the head-facing area and the non-head-facing area and the amount of the ink to be discharged on the printing medium is changed between the head-facing area and the non-head-facing area in the scanning process, positions where the amount of the ink is changed are varied.

9. A printing apparatus comprising:

a printhead for ink jet printing;

scanning control means configured to control the printhead to perform a scanning process in which ink is discharged from the printhead to a printing medium while scanning with the printhead by a plurality of times; and head-facing area changing means configured to differentiate head-facing areas to which the ink is discharged in a state of facing the printhead straight in front from each other in the respective scanning processes, characterized in that the scanning control means controls the printhead so that the ink is discharged to a non-head-facing area to which the ink is discharged without facing the non-head-facing area straight toward the printhead in any of the scanning processes without facing straight toward the printhead also in other one or more scanning processes, and the amount of the ink to be discharged in the non-head-facing area in at least one of the scanning processes is adjusted so that the total film thickness of the ink coating formed in the non-head-facing area becomes equal to the film thickness of the ink coating to be formed on the head-facing area, wherein when the ink is discharged to one point in the non-head-facing area in the n times (n is integers of 2 or larger) of the scanning process, an amount $D_i$ of the ink to be discharged to the point in the i-th scanning process is set so as to satisfy the following expression (2)

$$D_i = k_i \times D_0 \tag{2}$$

(where $D_0$ denotes the amount of the ink to be discharged to one point in the head-facing area in the respective scanning processes) by using a coefficient of adjustment $k_i$ set so as to satisfy the following expression (1)

[Expression 1]

$$\sum_{i=1}^{n} (k_i \cos\theta_i) = 1 \tag{1}$$

(where $\theta_i$ is an angle smaller than 90°, and indicates an angle formed between a discharging direction of the ink in the i-th scanning process among the n times of the scanning process and a normal direction of the printing medium at that time point.)

10. A printing apparatus comprising:

a printhead for ink jet printing;

scanning control means configured to control the printhead to perform a scanning process in which ink is discharged from the printhead to a printing medium while scanning with the printhead by a plurality of times; and head-facing area changing means configured to differentiate head-facing areas to which the ink is discharged in a state of facing the printhead straight in front from each other in the respective scanning processes, characterized in that the scanning control means controls the printhead so that the ink is discharged to a non-head-facing area to which the ink is discharged without facing the non-head-facing area straight toward the printhead in any of the scanning processes without facing straight toward the printhead also in other one or more scanning processes, and the amount of the ink to be discharged in the non-head-facing area in at least one of the scanning processes is adjusted so that the total film thickness of the ink coating formed in the non-head-facing area becomes equal to the film thickness of the ink coating to be formed on the head-facing area, wherein the ink is discharged to a first area, which is part of the printing medium, without facing the first area straight toward the printhead in two or more times of the scanning process, the two or more times of the scanning process includes one time of type 1 scanning process and one or more times of type 2 scanning process, the same amount of the ink as the amount to be discharged to the head-facing area is discharged to the first area in the type 1 scanning process, and an amount of ink smaller than the amount to be discharged to the head-facing area is discharged to the first area in the type 2 scanning process.

11. A printing method comprising:

a plurality of times of a scanning process including scanning with a printhead for ink jet printing and discharging ink to a printing medium from the printhead, characterized in that including differentiating head-facing areas to which the ink is discharged in a state of facing straight toward the printhead from each other in the respective scanning processes, discharging the ink to a non-head-facing area to which the ink is discharged in a state of not facing straight toward the printhead in any of the scanning processes without facing the non-head-facing area straight toward the printhead also in other one or more scanning processes, and adjusting the amount of the ink to be discharged in the non-head-facing area in at least one of the scanning processes so that the total film thickness of the ink coating formed in the non-head-facing area becomes a predetermined film thickness, wherein the ink is discharged to a first area, which is part of the printing medium, without facing the first area straight toward the printhead in two or more times of the scanning process, the two or more times of the scanning process includes one time of type 1 scanning process and one or more times of type 2 scanning process, the same amount of the ink as the amount to be discharged to the head-facing area is discharged to the first area in the type 1 scanning process, and an amount of ink smaller than the amount to be discharged to the head-facing area is discharged to the first area in the type 2 scanning process.

* * * * *